US008167297B2

(12) United States Patent
Shima et al.

(10) Patent No.: US 8,167,297 B2
(45) Date of Patent: May 1, 2012

(54) SHEET SEPARATING DEVICE AND METHOD FOR SEPARATING STACKED SHEETS

(75) Inventors: Yasuo Shima, Kawasaki (JP); Shunsuke Hattori, Kawasaki (JP); Hideichi Nakamoto, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 291 days.

(21) Appl. No.: 12/260,182

(22) Filed: Oct. 29, 2008

(65) Prior Publication Data

US 2009/0127768 A1 May 21, 2009

(30) Foreign Application Priority Data

Oct. 29, 2007 (JP) ..... P2007-280474

(51) Int. Cl.
*B65H 3/14* (2006.01)
*B65H 3/46* (2006.01)

(52) U.S. Cl. ..... 271/98; 271/97; 271/104; 271/109

(58) Field of Classification Search ..... 271/97, 271/98, 104, 105
See application file for complete search history.

(56) References Cited

U.S. PATENT DOCUMENTS 3,980,293 A * 9/1976 Shelmire ..... 271/93
4,325,494 A * 4/1982 Fish ..... 221/13
4,696,462 A * 9/1987 Tanaka et al. ..... 271/10.11
5,188,350 A * 2/1993 Hayashi ..... 271/114
5,290,023 A * 3/1994 Sasaki et al. ..... 271/20
5,462,373 A * 10/1995 Chia ..... 400/624
5,921,540 A * 7/1999 Acquaviva et al. ..... 271/98
6,543,759 B2 * 4/2003 Yamaguchi et al. ..... 271/98
6,729,614 B2 5/2004 Okazaki et al.
6,942,208 B2 * 9/2005 Okazaki et al. ..... 271/97
7,677,553 B2 * 3/2010 Ikeda ..... 271/98
2009/0014948 A1 * 1/2009 Takahashi ..... 271/264

FOREIGN PATENT DOCUMENTS

JP 54144670 A * 11/1979
JP 61162435 A * 7/1986
JP 04-023747 1/1992
JP 05286596 A * 11/1993
JP 05306045 A * 11/1993
JP 05319584 A * 12/1993
JP 2003-063675 3/2003

* cited by examiner

*Primary Examiner* — Michael McCullough
*Assistant Examiner* — Luis A Gonzalez
(74) *Attorney, Agent, or Firm* — Turocy & Watson, LLP

(57) ABSTRACT

A sheet separating device includes: an air blowing unit that is configured to blow air toward a side face of stacked sheets being stacked with a plurality of sheets to separate the sheets by forming an air layer between the sheets; and a sheet pressing unit that is configured to apply a pressing force on the uppermost sheet in the stacked sheets while the uppermost sheet is separated from other sheets, the pressing force having a downward component and a component in a direction along the uppermost sheet.

7 Claims, 4 Drawing Sheets

SHEET SEPARATING DEVICE AND METHOD FOR SEPARATING STACKED SHEETS

CROSS-REFERENCE TO THE RELATED APPLICATION(S)

The present disclosure relates to the subject matters contained in Japanese Patent Application No. 2007-280474 filed on Oct. 29, 2007, which are incorporated herein by reference in its entirety.

FIELD

The present invention relates to a sheet separating device and a method for separating stacked sheets.

BACKGROUND

In recent years, a sheet feeding unit that feeds sheets to be used in an image forming apparatus, such as printers and copying machines, is required to handle various types and sizes of the sheets and to reliably feed a large number of sheets in high speed with high accuracy. In order to reliably feed a single sheet from the stacked sheets of various types, there is known an air-assisted sheet feeding mechanism that is provided with a mechanism to blow air from a side face of the stacked sheets near the uppermost sheet at a position downstream to a position where a feed roller feeds the sheet.

In a conventional air-assisted sheet feeding mechanism, the air is blown to the side face of the stacked sheets while the uppermost sheet is held by a holding member provided at a rear end of the uppermost sheet, to thereby prevent the whole sheets in the stacked sheets float up. An example of such mechanism is disclosed in JP-4-023747-A. In the conventional mechanism, the air is blown into several tens of sheets from the uppermost sheet that is held by the holding member, to thereby form an air layer between the sheets to reduce a frictional force therebetween when feeding the sheets.

There is also known a feeding mechanism that is provided with a floating prevention member disposed at a position between an air outlet and a feed roller. An example of such mechanism is disclosed in JP-3592275-B2 (corresponding U.S. publication is: U.S. Pat. No. 6,729,614 B2).

When the air is blown into the side face of the stacked sheets in the conventional air-assisted sheet feeding mechanism, there occur a gap into which the air easily enters and a gap into which the air hardly enters due to a difference in the suction state between the sheets, to a difference in charging amount, and to a difference in a moisture absorption state. In the gap where the air hardly enters, the air would not enter across the sheets and the sheets swell in a state where the sheets partially being contact with each other. When a feed operation is performed in such state, the sheets between which the air is not duly blown may be improperly fed, thereby causing a multi feed. At worst, the sheets could not pass through separation rollers, which causes a misfeed.

As describe above, in the conventional air-assisted sheet feeding mechanism, a misfeed, such as a multi feed and an idle feed, may occur due to the suction between the sheets caused by moistures and electrostatic charge. Particularly for a case in which coated sheets having water-shedding property are used, those coated sheets absorb moistures while being exposed to a highly humid environment to be adhere to one another, whereby the multi feed and the misfeed prominently occurs.

In order to unravel the sheets adhered to one another, it is necessary to separate the adhered sheets before performing the feeding operation. There is proposed a mechanism to separate the adhered sheets by blowing air into the side face of the stacked sheets to send the air into contact surfaces between the sheets to form an air layer therebetween, to thereby reduce frictional resistance. As such mechanism, the there is known the air-assisted sheet feeding mechanism described in the above. However, each of the sheets may not be properly separated when adhesive force between the sheets differs between the sheets.

SUMMARY

According to a first aspect of the present invention, there is provided a sheet separating device including: an air blowing unit that is configured to blow air toward a side face of stacked sheets being stacked with a plurality of sheets to separate the sheets by forming an air layer between the sheets; and a sheet pressing unit that is configured to apply a pressing force on the uppermost sheet in the stacked sheets while the uppermost sheet is separated from other sheets, the pressing force having a downward component and a component in a direction along the uppermost sheet.

According to a second aspect of the present invention, there is provided a method for separating stacked sheets, the method including: blowing air toward a side face of the stacked sheets being stacked with a plurality of sheets to separate the sheets by forming an air layer between the sheets; and applying a pressing force on the uppermost sheet in the stacked sheets while the uppermost sheet is separated from other sheets, the pressing force having a downward component and a component in a direction along the uppermost sheet.

DETAILED DESCRIPTION OF THE EMBODIMENTS

Figure 1:
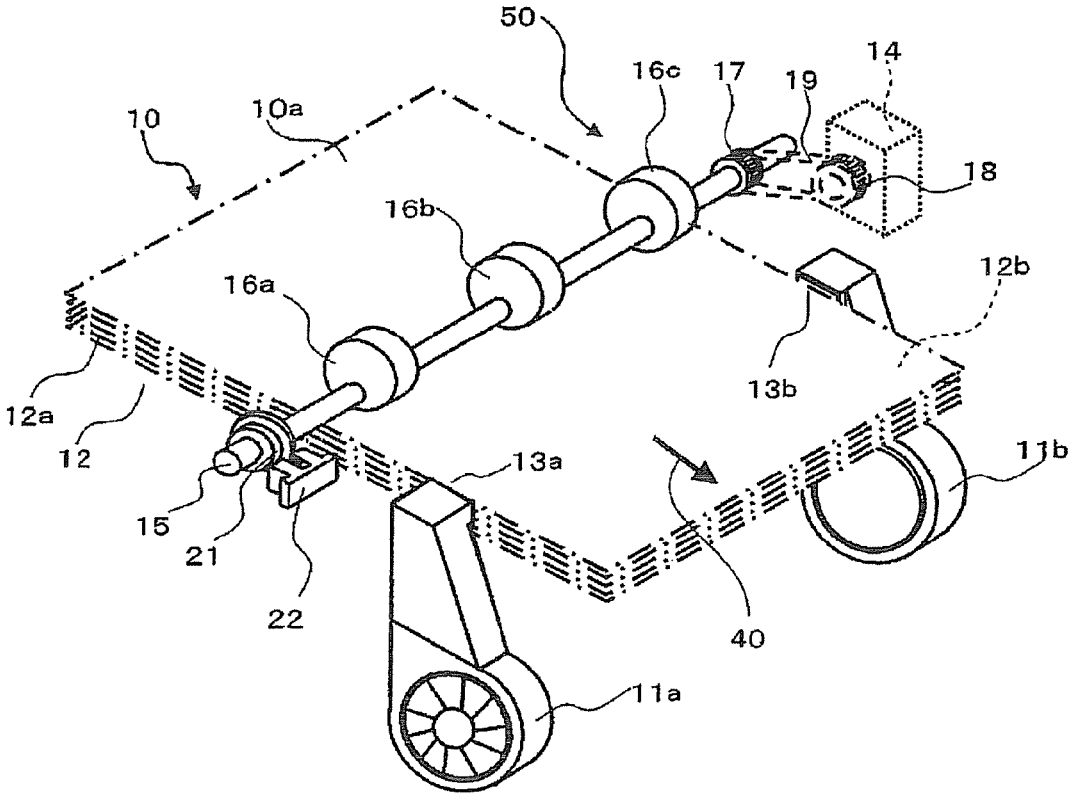
FIG. 1 is a schematic perspective view showing the configuration of a sheet separating device according to a first embodiment of the present invention.

Hereinafter, embodiments of the invention will be described with reference to the drawings. In the following description, the same or similar components will be denoted by the same reference numerals, and the duplicate description thereof will be omitted.

First Embodiment

Figure 2:
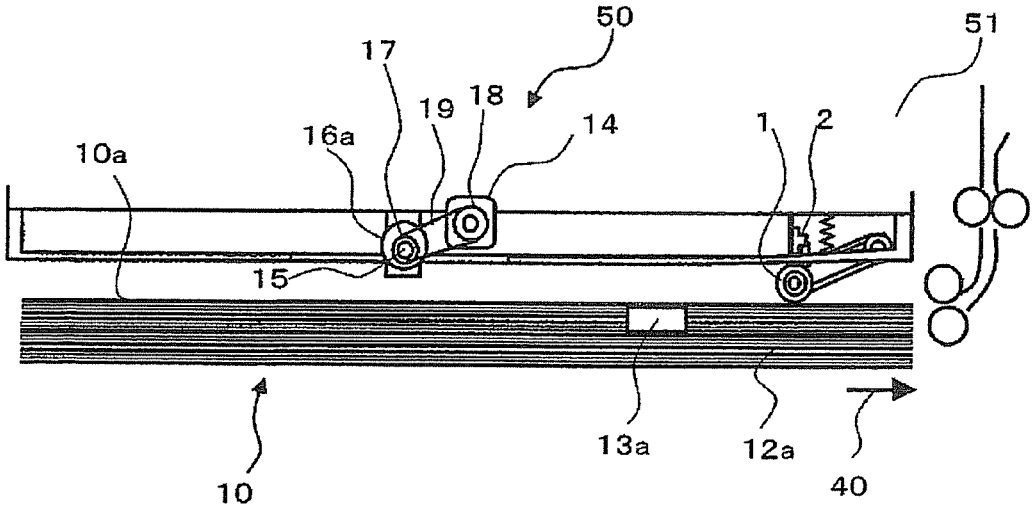
FIG. 2 is a schematic front view showing a state before starting a separation operation by the sheet separating device.
Figure 3:
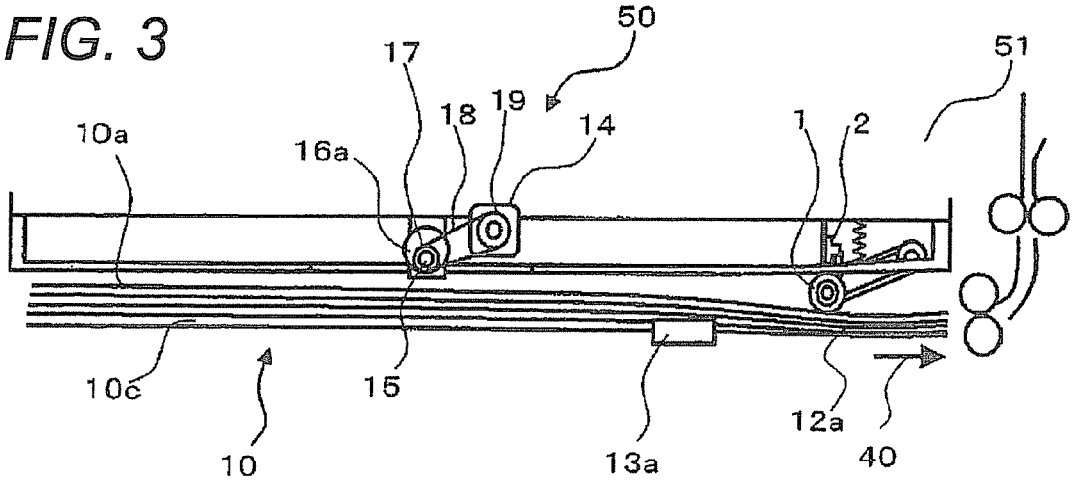
FIG. 3 is a schematic front view showing a state where air is blown toward stacked sheets by first and second blowers in the sheet separating device.
Figure 4:
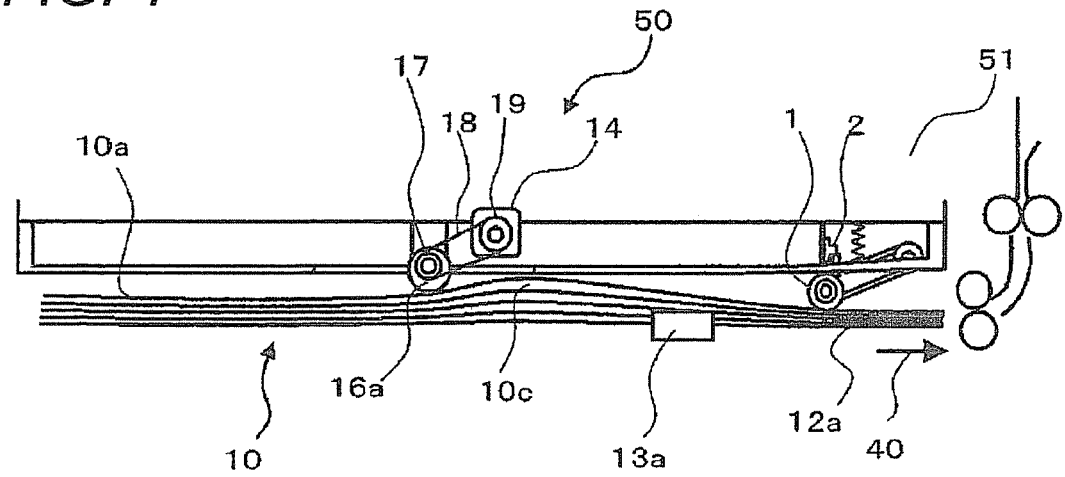
FIG. 4 is a schematic front view showing a state where an uppermost sheet of the stacked sheets is pressed by eccentric rollers in the sheet separating device.

A sheet separating device according to a first embodiment of the present invention will be described with reference to FIGS. 1-4. FIG. 1 is a schematic perspective view of the sheet separating device according to the first embodiment. FIGS. 2-4 are schematic front views showing a series of operations for separating sheets by the sheet separating device.

As shown in FIG. 1, in the sheet separating device in which sheets (hereinafter referred to as stacked sheets 10) are arranged, a first blower 11*a* and a second blower 11*b* which blow air in a horizontal direction perpendicular to a sheet conveying direction 40 are arranged at a side faces 12 of the stacked sheets 10 along a stacked direction of the stacked sheets 10. Moreover, a stacked sheet pressing member 50 which presses an uppermost sheet 10*a* of the stacked sheets 10 by three eccentric rollers, i.e., a first eccentric roller 16*a*, a second eccentric roller 16*b*, and a third eccentric roller 16*c*, which are arranged above the stacked sheets 10, is arranged.

The first blower 11*a* is arranged so as to blow air toward a first side face 12*a* from a first air outlet 13*a*. A second blower 11*b* is arranged so as to blow air horizontally against a second side face 12*b* opposite the above side face, from a second air outlet 13*b*. In this embodiment, the sheet separating device is configured that the blowing direction of air is a direction substantially vertical to the sheet conveying direction 40.

The eccentric rollers 16*a*, 16*b*, and 16*c* are arranged along the air blowing direction in which the first and second blowers 11*a* and 11*b* blow air. Further, the eccentric rollers 16*a*, 16*b*, and 16*c* have a cylindrical shape, are eccentric with respect to a rotary shaft 15, and are fixed thereto by connecting elements, such as screws (not shown). The eccentric rollers 16*a*, 16*b*, and 16*c* are arranged in the same phase as each other. The rotary shaft 15 extends in the horizontal direction perpendicular to the sheet conveying direction 40.

The driving mechanism of the eccentric rollers 16*a*, 16*b*, and 16*c* includes a first timing pulley 17 connected with the rotary shaft 15, a second timing pulley 18 connected with a pulse motor 14 or the like, and a timing belt 19 stretched over the timing pulleys 17 and 18.

As for the position detection of the eccentric rollers 16*a*, 16*b*, and 16*c*, the eccentric rollers are set so that the apexes of the eccentric rollers 16*a*, 16*b*, and 16*c* can be recognized by a position-detecting target 21 provided in the rotary shaft 15, and a position-detecting sensor, for example, a photo-interrupter 22, fixed to an upper wall face (not shown).

The operation of the sheet separating device configured as above will be described with reference to FIGS. 2-4.

FIG. 2 is a schematic front view showing an example of the separation operation by the sheet separating device shown in FIG. 1, and showing a state before starting the separation operation.

The stacked sheets 10 is lifted upward by a lifting mechanism (not shown), and stops at a position where the position-detecting sensor 2 of a feed roller 1 arranged in a sheet feeding mechanism 51 has detected a setting position. At this time, the eccentric rollers 16*a*, 16*b*, and 16*c* is stopped in an uppermost position, and are retreated in a state apart from the uppermost sheet 10*a* of the stacked sheets 10.

FIG. 3 is a schematic front view showing a state where air is blown toward the stacked sheets 10 by the first and second blowers 11*a* and 11*b*.

The first blower 11*a* and the second blower 11*b* are operated to blow air toward the first side face 12*a* and the second side face 12*b* by the first air outlet 13*a* and the second air outlet 13*b*. The stacked sheets 10 toward which air has been blown swell upward in a state where an air layer 10*c* is formed. Here, the shape of a cross-section vertical to the direction in which air is blown is referred to as "swelling shape."

When the air is simply blown, the stacked sheets 10 may not be separated one by one, and may form the swelling shape while sheets closely contact each other partially.

FIG. 4 is a schematic front view showing a state where the uppermost sheet 10*a* of the stacked sheets 10 is pressed by the eccentric rollers.

A pulse motor 14 is rotated, thereby rotating the eccentric rollers 16*a*, 16*b*, and 16*c* connected via the rotary shaft 15. When the eccentric rollers 16*a*, 16*b*, and 16*c* are lowered while being rotated, their end faces push the uppermost sheet 10*a* of the stacked sheets 10 toward which air is blown in advance and which form a swelling shape while being partially attached to other sheets.

When the uppermost sheet 10*a* is pressed, the end faces of the eccentric rollers 16*a*, 16*b*, and 16*c* rotate while contacting the uppermost sheet 10*a*. Accordingly, the position where the end faces and the uppermost sheet 10*a* comes into contact with each other, i.e., the position where the eccentric rollers 16*a*, 16*b*, and 16*c* presses the uppermost sheet 10*a*, varies every moment until the end faces are separated from the uppermost sheet 10*a* after the end faces touch the uppermost sheet. In addition, since the end faces and the uppermost sheet 10*a* repeat contact and separation, the operation of pressing against the stacked sheets 10 is intermittently performed.

At this time, the pressed amount of the eccentric rollers into the stacked sheets 10 which have swelled by blowing of air in a direction perpendicular to a sheet plane varies every moment. As a result, the swelling shape of the stacked sheets 10 pushed by the eccentric rollers 16*a*, 16*b*, and 16*c* varies with the variation of the pressed amount. By the change of this swelling shape, a rubbing force acts between sheets which overlap each other and closely contact each other partially.

Further, since the end faces rotate while contacting the uppermost sheet 10*a*, a frictional force acts between the end faces and the sheet surface. The force along the surface of the uppermost sheet will act on the uppermost sheet 10*a* by this frictional force. By the force along the surface the uppermost sheet, a rubbing force acts between sheets which overlap each other and closely contact each other partially. This rubbing force has only to be provided so as not to run along the direction in which air is blown, and desirably acts vertically to the blowing direction of air.

By the above rubbing force which acts between sheets, the adhered state between the sheets can be released, and the sheets can be separated from one another.

Moreover, as the positional relationship of the air outlets 13*a* and 13*b* of the blowers 11*a* and 11*b* relative to the stacked sheets 10 which closely contact each other partially varies, air can be uniformly blown between the sheets that are adhered to one another.

Accordingly, it is possible to stably feed air into the stacked sheets 10 to separate the stacked sheets 10, thereby performing stable separation operation.

In addition, as for the timing with which three eccentric rollers 16*a*, 16*b*, and 16*c* push the uppermost sheet 10*a* of the stacked sheets 10, the phases of the rollers may deviate from each other. Further, the shape of the eccentric rollers 16*a*, 16*b*, and 16*c* is not limited to a cylindrical shape so long as they intermittently exert a pressing force having components in directions vertical and horizontal to the uppermost sheet 10*a*.

Further, it is possible to change contact positions up and down while the end faces of the eccentric rollers 16*a*, 16*b*, and 16*c* always contact the uppermost sheet 10*a* without being separated therefrom, thereby performing pressing operation.

Second Embodiment

Figure 5:
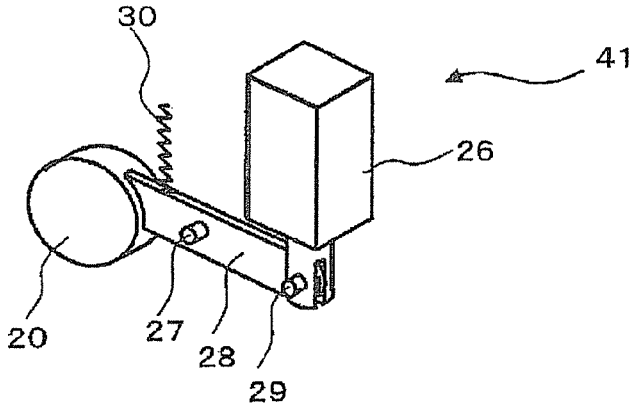
FIG. 5 is a schematic perspective view showing the configuration of a sheet pressing mechanism according to a second embodiment of the present invention.

A sheet separating device according to a second embodiment of the present invention will be described with reference to FIGS. 5-9. FIG. 5 is a schematic perspective view showing a sheet pressing mechanism 41 arranged in the stacked sheet pressing member 50 related to the sheet separating device of this embodiment. FIGS. 6-9 are schematic front views showing a series of operations of separating the stacked sheets 10 by the sheet separating device of this embodiment.

The sheet pressing mechanism 41 according to the second embodiment is configured so as to change the pressing position of the uppermost sheet along the sheet conveying direction 40 over time while pressing the uppermost sheet 10*a* of the stacked sheets 10, i.e., swing the uppermost sheet in the horizontal direction with a predetermined amplitude. The stacked sheet pressing member 50 includes a linear sliding mechanism 33 which is attached to the upper side of the sheet feeding mechanism 51, and is swingable in the horizontal direction, the sheet pressing mechanism 41 which is arranged in a moving base 34 (moving portion) of the linear sliding mechanism 33, and the like.

As shown in FIG. 5, the sheet pressing mechanism 41 includes a sheet pressing member 20 which presses the stacked sheets 10 from above, a lever 28 which supports the sheet pressing member 20, a lever rotation supporting pin 27 which supports the rotation of the lever 28, an urging spring 30, and a connecting pin 29 connected with the lever 28 by a solenoid 26. When the solenoid 26 moves upward, the connecting pin 29 is moved upward, the sheet pressing member 20 is lowered, and the urging spring 30 (tension coil spring) is extended.

Figure 6:
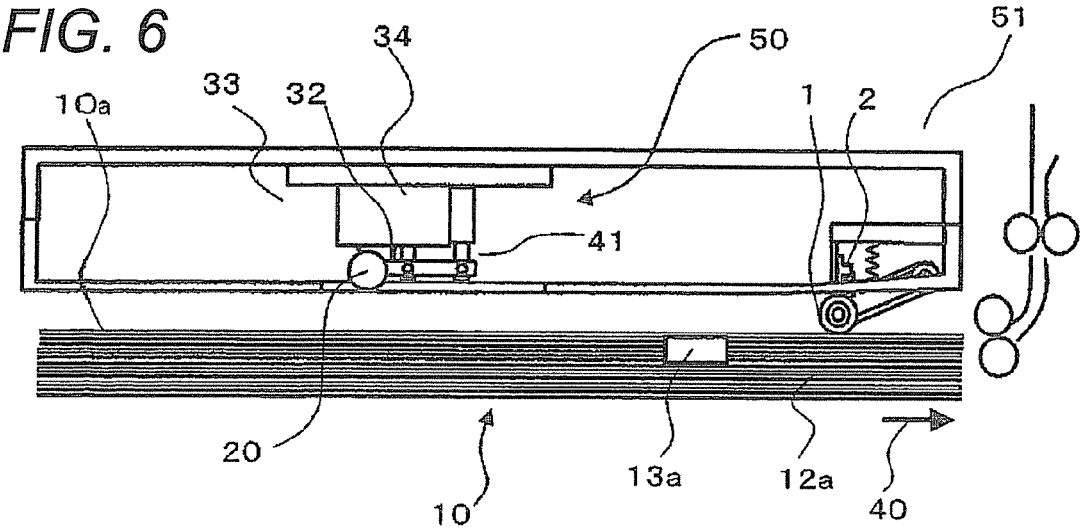
FIG. 6 is a schematic front view showing a state before starting the separation operation in the second embodiment of the sheet separating device.

FIG. 6 shows a state before starting the separation operation of the sheet separating device according to the second embodiment.

The stacked sheets 10 is lifted upward by a lifting mechanism (not shown), and stops at a position where the position-detecting sensor 2 of a feed roller 1 arranged in a sheet feeding mechanism 51 has detected a setting position. At this time, the sheet pressing member 20 is positioned in the uppermost position by the urging spring 30 and a stopper 32 and is retreated in a state of being apart from the uppermost sheet 10*a*.

Figure 7:
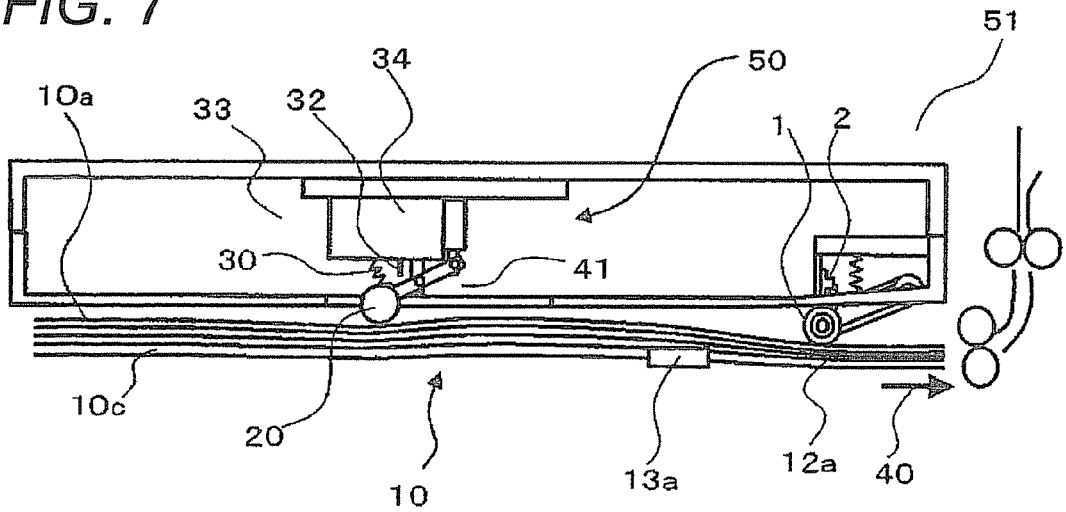
FIG. 7 is a schematic front view showing a state where a sheet pressing member in the second embodiment of the sheet separating device presses the uppermost sheet in the stacked sheets.

FIG. 7 is a schematic front view showing a state where the sheet pressing member 20 is pressing the uppermost sheet 10*a*.

First, similarly to the first embodiment, the first blower 11*a* and the second blower 11*b* are operated to blow air toward the first side face 12*a* and the second side face 12*b* of the stacked sheets 10 by the first air outlet 13*a* and the second air outlet 13*b*. The stacked sheets 10 toward which air has been blown swell upward in a state where an air layer 10*c* is formed between overlapping sheets. In addition, at this time, the stacked sheets 10 may not be separated one by one, and may form the swelling shape while sheets closely contact each other. In addition, similarly to the first embodiment, the blowing direction of air is a direction perpendicular to the sheet conveying direction 40.

Next, the uppermost sheet 10*a* of the stacked sheets 10 which form the air layer 10*c* and swells by air blowing in advance is pressed by applying an electric current to the solenoid 26 to drive the lever 28.

The sheet pressing member 20 according to the second embodiment may be configured so as to move while sliding on the surface of the uppermost sheet 10*a*. Alternatively, the sheet pressing member may be a rotary body which moves horizontally while rolling on the surface of the uppermost sheet 10*a*.

Figure 8:
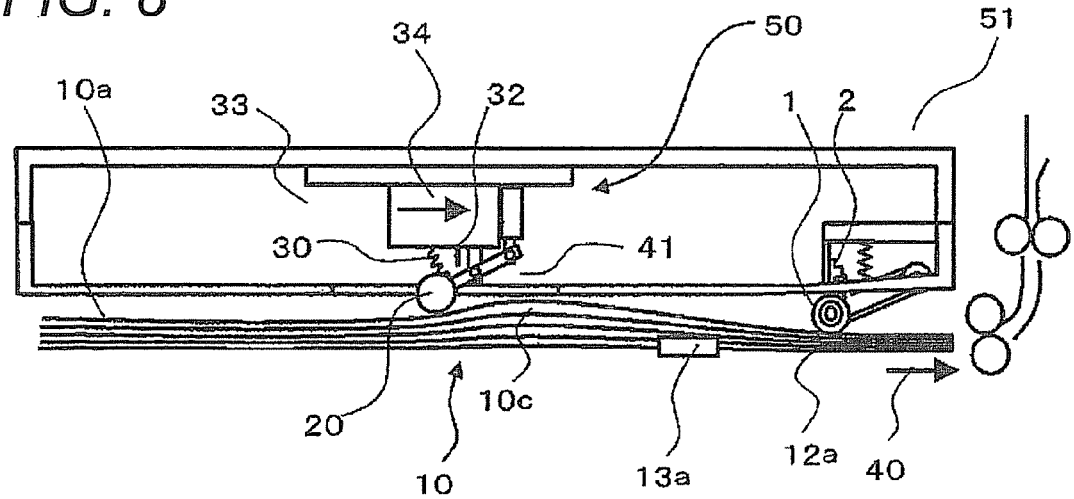
FIG. 8 is a schematic front view showing a state where a linear sliding mechanism in the second embodiment of the sheet separating device is moved in the horizontal direction.

FIG. 8 is a schematic front view showing a state where the sheet pressing mechanism 41 has been moved in the horizontal direction by the linear sliding mechanism 33.

The pressing member 20 of the sheet pressing mechanism 41 moves along the sheet conveying direction 40 by a drive mechanism (not shown) including an actuator, such as a motor. At this time, the swelling shape of the stacked sheets 10 formed by blowing of air is changed every moment in accordance with the movement of the sheet pressing member 20.

Figure 9:
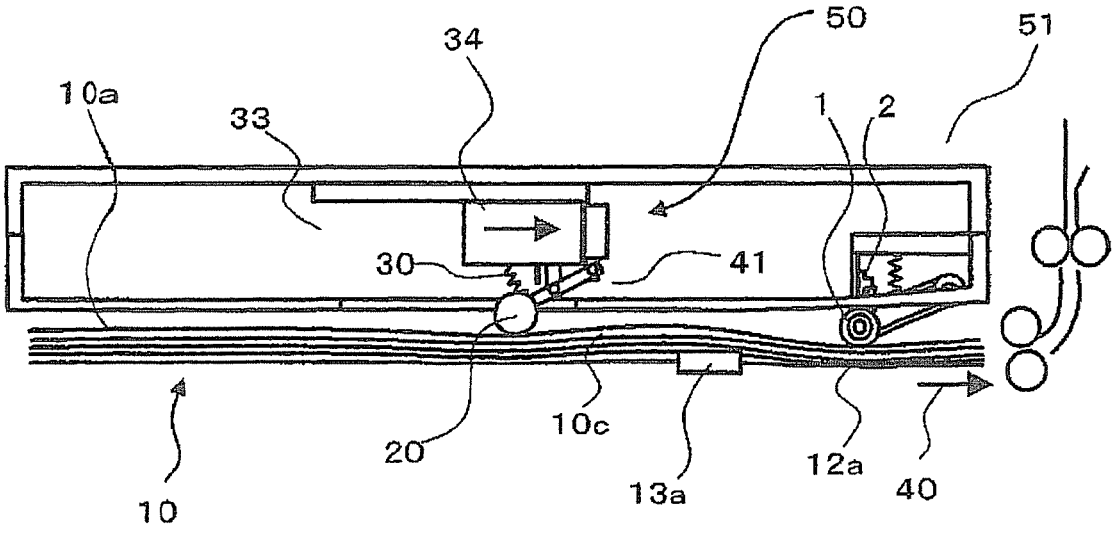
FIG. 9 is a schematic front view showing a state where the sheet pressing mechanism shown in FIG. 8 is further moved in the horizontal direction by the linear sliding mechanism.

FIG. 9 is a schematic front view showing a state where the sheet pressing mechanism 41 shown in FIG. 8 is further moved horizontally by the linear sliding mechanism 33. The swelling shape shown in FIG. 9 is deformed to the swelling shape shown in FIG. 8 as the sheet pressing member 41 moves horizontally.

By making the sheet pressing member swing in the direction which runs along the sheet conveying direction 40 by the linear sliding mechanism 33 after a series of operations shown in FIGS. 6-9, the sheets which closely contact each other partially can be separated.

The position where the sheet pressing member 20 presses the uppermost sheet 10*a* varies every moment because the sheet pressing member swings in the horizontal direction while being pushed by the linear sliding mechanism 33. As a result, the stacked sheets 10 pushed by the sheet pressing member 20 changes the swelling shape of the stacked sheets 10 with the change of the pressing position thereof. At this time, similarly to the first embodiment, a rubbing force acts between sheets which overlap each other and closely contact each other partially. Thus, the adhered state between the sheets can be released, and the sheets can be separated from each other.

Further, since the sheet pressing member swings in the horizontal direction while pressing the uppermost sheet 10*a*, a frictional force acts between the pressing surface of the sheet pressing member 20, and the sheet surface. The force along the surface of the uppermost sheet will act on the uppermost sheet 10*a* by this frictional force. Similarly to the first embodiment, by the force along the surface the uppermost sheet, a rubbing force acts between sheets which overlap each other and closely contact each other partially.

By the above rubbing force which acts between sheets, the adhered state between the sheets can be released, and the sheets can be separated from each other.

Further, the sheet separating mechanism according to the second embodiment can increase the horizontal moving distance of the sheet pressing member 20 compared with the first embodiment. Accordingly, a larger rubbing force acts on each of the sheets which closely contact each other. Therefore, the performance of separating the stacked sheets 10 is further improved.

Moreover, similarly to the first embodiment, as the positional relationship of the air outlets 13*a* and 13*b* of the blowers 11*a* and 11*b* relative to the stacked sheets 10 which closely contact each other partially varies, air can be uniformly blown between the sheets which closely contact each other.

Accordingly, it is possible to reliably feed air into the stacked sheets 10, and to stably perform the separation operation of separating the stacked sheets 10.

In addition, the swinging direction is not limited to the direction along the sheet conveying direction 40 so long as it does not run along the direction in which air is blow.

Further, a plurality of the sheet pressing mechanisms 41 may be arranged in parallel above the uppermost sheet 10*a* along the surface thereof.

In the above embodiment, air is blown in the vertical direction to the sheet conveying direction 40. However, the sheet separating device may be configured such that the horizontal component of a pressing force generated by the stacked sheet pressing member 50 does not acts in a direction along the air blowing direction.

Further, a stacked sheet pressing member 50 having the eccentric rollers 16*a*, 16*b*, and 16*c* used in the first embodiment and the linear sliding mechanism 33 used in the second embodiment may be combined.

In addition, the sheets are not limited to paper sheets, and may be sheets of any material, such as those used for an overhead projectors (OHP).

It is to be understood that the present invention is not limited to the specific embodiments described above and that the present invention can be embodied with the components modified without departing from the spirit and scope of the present invention. The present invention can be embodied in various forms according to appropriate combinations of the components disclosed in the embodiments described above. For example, some components may be deleted from the configurations described as the embodiments. Further, the components described in different embodiments may be used appropriately in combination.

What is claimed is:

1. A sheet separating device comprising:

an air blowing unit that is configured to blow air toward a side face of stacked sheets being stacked with a plurality of sheets to separate the sheets by forming an air layer between the sheets; and a sheet pressing unit further comprising:

a rotary shaft that is disposed above the uppermost sheet to be in parallel with the sheets; and a plurality of eccentric rollers that are attached to the rotary shaft, wherein the eccentric rollers are configured to rotate along with rotation of the rotary shaft while repeat contacting and separating from the uppermost sheet, wherein the sheet pressing unit is configured to apply a pressing force on the uppermost sheet in the stacked sheets while the uppermost sheet is separated from other sheets, the pressing force having a downward component and a component in a direction along the uppermost sheet and is further configured to apply the pressing force on the uppermost sheet while varying a position where the pressing force acts in a direction in which the sheets are stacked, and wherein the eccentric rollers are configured to apply the pressing force at timings different from one another.

2. The device according to claim 1, wherein the sheet pressing unit comprises:

a linear sliding mechanism that is disposed above the stacked sheets and comprises a moving member that is configured to move in a direction along the uppermost sheet; and a pressing member that is attached to the moving member and configured to apply the pressing force to the uppermost sheet.

3. The device according to claim 2, wherein the moving member is configured to swing in a direction along the uppermost sheet.

4. A method for separating stacked sheets, the method comprising:

blowing air toward a side face of the stacked sheets being stacked with a plurality of sheets to separate the sheets by forming an air layer between the sheets; and applying a pressing force on the uppermost sheet in the stacked sheets while the uppermost sheet is separated from other sheets, the pressing force is applied by a plurality of eccentric rollers which are disposed on a rotary shaft that is disposed above the uppermost sheet and parallel with the sheets and are rotating with rotation of the shaft which apply the pressing force at different timings to each other and to be intermittently contacting and separating from the uppermost sheet while varying a position where the pressing force acts in a direction in which the sheets are stacked, the pressing force having a downward component and a component in a direction along the uppermost sheet.

5. A sheet separating device comprising:

an air blowing unit that is configured to blow air toward a side face of stacked sheets being stacked with a plurality of sheets to separate the sheets by forming an air layer between the sheets; and a sheet pressing unit further comprising:

a rotary shaft that is disposed above the uppermost sheet to be in parallel with the sheets; and a plurality of eccentric rollers that are attached to the rotary shaft, wherein the eccentric rollers are configured to rotate along with rotation of the rotary shaft while being in contact with the uppermost sheet without being separated from the uppermost sheet, wherein the sheet pressing unit is configured to apply a pressing force on the uppermost sheet in the stacked sheets while the uppermost sheet is separated from other sheets, the pressing force having a downward component and a component in a direction along the uppermost sheet and is further configured to apply the pressing force on the uppermost sheet while varying a position where the pressing force acts in a direction in which the sheets are stacked and wherein the sheet pressing unit comprises a plurality of pressing members arranged above the stacked sheets, the pressing members being configured to apply the pressing force at timings different from one another.

6. The device according to claim 5, wherein the sheet pressing unit comprises:

a linear sliding mechanism that is disposed above the stacked sheets and comprises a moving member that is configured to move in a direction along the uppermost sheet; and a pressing member that is attached to the moving member and configured to apply the pressing force to the uppermost sheet.

7. The device according to claim 6, wherein the moving member is configured to swing in a direction along the uppermost sheet.

* * * * *